US012390085B1

(12) United States Patent
Diaz

(10) Patent No.: US 12,390,085 B1
(45) Date of Patent: Aug. 19, 2025

(54) BOOT SCRUBBER DEVICE INTEGRATED IN FLOOR AND RELATED METHODS

(71) Applicant: Luis G. Diaz, Lake Helen, FL (US)

(72) Inventor: Luis G. Diaz, Lake Helen, FL (US)

(73) Assignees: Luis G. Diaz, Lake Helen, FL (US); David Diaz, Lake Helen, FL (US)

( * ) Notice: Subject to any disclaimer, the term of this patent is extended or adjusted under 35 U.S.C. 154(b) by 0 days.

(21) Appl. No.: 19/052,707

(22) Filed: Feb. 13, 2025

(51) Int. Cl.

| | |
|---|---|
| ***A47L 23/02*** | (2006.01) |
| ***A46B 5/06*** | (2006.01) |
| ***A46B 13/02*** | (2006.01) |
| ***A46B 15/00*** | (2006.01) |
| ***A46B 17/08*** | (2006.01) |
| ***A47L 23/26*** | (2006.01) |

(52) U.S. Cl.
CPC ..... *A47L 23/02* (2013.01); *A46B 5/06* (2013.01); *A46B 13/02* (2013.01); *A46B 15/0008* (2013.01); *A46B 17/08* (2013.01); *A47L 23/26* (2013.01); *A46B 2200/306* (2013.01)

(58) Field of Classification Search
CPC ..... A47L 23/02; A47L 23/26; A47L 23/263; A47L 23/266
See application file for complete search history.

(56) References Cited

U.S. PATENT DOCUMENTS

| | | | |
|---|---|---|---|
| 3,044,099 A | | 7/1962 | Scott et al. |
| 4,951,345 A | * | 8/1990 | Nappi, Sr. ..... A47L 23/263 15/302 |
| 7,472,452 B2 | | 1/2009 | Junell |
| 7,676,876 B1 | | 3/2010 | Ewert |
| 7,725,974 B2 | | 6/2010 | Hughes |
| 10,898,603 B2 | | 1/2021 | Dombrowsky et al. |
| 11,246,470 B1 | | 2/2022 | McKeon |
| 11,432,692 B2 | | 9/2022 | Shin |
| 2009/0199867 A1 | | 8/2009 | Woods |

(Continued)

FOREIGN PATENT DOCUMENTS

| | | | | |
|---|---|---|---|---|
| CN | 108852257 A | * | 11/2018 | ..... A47L 23/26 |
| CN | 110974119 A | * | 4/2020 | ..... A47L 23/24 |

OTHER PUBLICATIONS

"BSX800 Compact Walk Through Boot Scrubber" Unit https://nelsonjameson.com/bsx800-compact-walk-through-boot-scrubber-unit-bsx800v-daf-91706.html?quer: Retrieved from internet Feb. 26, 2025 1 pg.

(Continued)

*Primary Examiner* — Shay Karls
(74) *Attorney, Agent, or Firm* — Allen, Dyer, Doppelt + Gilchrist, PA

(57) ABSTRACT

A boot scrubber device is within a floor. The boot scrubber device may include a housing assembly having a frame to be received by the floor and defining an opening, and a plate pivotably coupled to the frame and received within the opening. The plate may define a brush opening. The boot scrubber device may include a belt brush assembly carried by the housing assembly and aligned with the brush opening. The belt brush assembly may include a belt base, and laterally arranged brushes carried by the belt base. The boot scrubber device may also include a motor carried by the housing assembly and configured to drive the belt brush assembly, and a controller carried by the housing assembly and configured to activate the motor when a user steps on the plate.

20 Claims, 7 Drawing Sheets

(56) References Cited

U.S. PATENT DOCUMENTS

| | | | |
|---|---|---|---|
| 2014/0196235 | A1 | 7/2014 | Nappi, Sr. |
| 2022/0248937 | A1 | 8/2022 | Gonzalez |

OTHER PUBLICATIONS

"Meritech Automated Boot Washing Stations & Footwear Sanitizing Technology" https://www.meritech.com/products/boot-scrubbers: Retrieved from internet Feb. 26, 2025 1 pg.

* cited by examiner

BOOT SCRUBBER DEVICE INTEGRATED IN FLOOR AND RELATED METHODS

TECHNICAL FIELD

The present disclosure relates to the field of footwear cleaning devices, and, more particularly, to a boot scrubber device and related methods.

BACKGROUND

Given the nature of footwear, they are a reliable source for contamination and debris in many structures. Depending on the weather, users may track in water, dirt, snow, and other debris, which is a source of uncleanliness and potentially disease. Because of this somewhat ancient problem, there are many approaches. For example, door mats are a relatively common and inexpensive approach. Of course, the durability of this approach and user effort are drawbacks.

Another approach is the automated boot scrubber, for example, as disclosed in U.S. Pat. No. 3,044,099 to Scott or U.S. Pat. No. 10,898,603 to Dombrowsky. These approaches may suffer from maintenance issues and are complex to manufacture.

SUMMARY

Generally, a boot scrubber device is within a floor. The boot scrubber device may include a housing assembly comprising a frame to be received by the floor and defining an opening therein, and a plate pivotably coupled to the frame and received within the opening. The plate may define a brush opening. The boot scrubber device may include a belt brush assembly carried by the housing assembly and aligned with the brush opening. The belt brush assembly may include a belt base, and a plurality of laterally arranged brushes carried by the belt base. The boot scrubber device may also include a motor carried by the housing assembly and configured to drive the belt brush assembly, and a controller carried by the housing assembly and configured to activate the motor when a user steps on the plate.

In some embodiments, the housing assembly may comprise a subsurface frame coupled to an underside of the plate and carrying the belt brush assembly and the motor. The boot scrubber device may also include a waste bin carried by the subsurface frame under the belt brush assembly. The waste bin may be configured to collect debris from shoes of the user. The boot scrubber device may further comprise a flap carried by the subsurface frame adjacent to the belt brush assembly. The flap may be configured to urge the debris into the waste bin. The waste bin may comprise a body defining a recess therein, and a handle coupled to the body. The plate may be configured to pivot between a first position being flush with the frame and the floor, and a second position being transverse to the frame and the floor, thereby permitting the waste bin to be slidingly removed from the subsurface frame.

In particular, the belt brush assembly may comprise a first chain coupled to the belt base, and the motor may be configured to drive the first chain. The belt brush assembly may comprise a second chain, and a sprocket gear coupled between the first chain and the second chain. The motor may be configured to drive the first chain via the second chain. The belt base may comprise a plurality of longitudinal strips coupled together, and a plurality of brush sets respectively coupled to the plurality of longitudinal strips. The boot scrubber device may also include a pressure sensor carried by the housing assembly and coupled to the controller, and the controller may be configured to detect when the user steps on the plate based upon the pressure sensor.

Another aspect is directed to a method for making a boot scrubber device within a floor. The method may include positioning a housing assembly comprising a frame to be received by the floor and defining an opening therein, and a plate pivotably coupled to the frame and received within the opening, the plate defining a brush opening. The method also may include coupling a belt brush assembly to be carried by the housing assembly and aligned with the brush opening. The belt brush assembly may include a belt base, and a plurality of laterally arranged brushes carried by the belt base. The method may further comprise coupling a motor to be carried by the housing assembly and configured to drive the belt brush assembly, and coupling a controller to be carried by the housing assembly and configured to activate the motor when a user steps on the plate.

DETAILED DESCRIPTION

Figure 1:
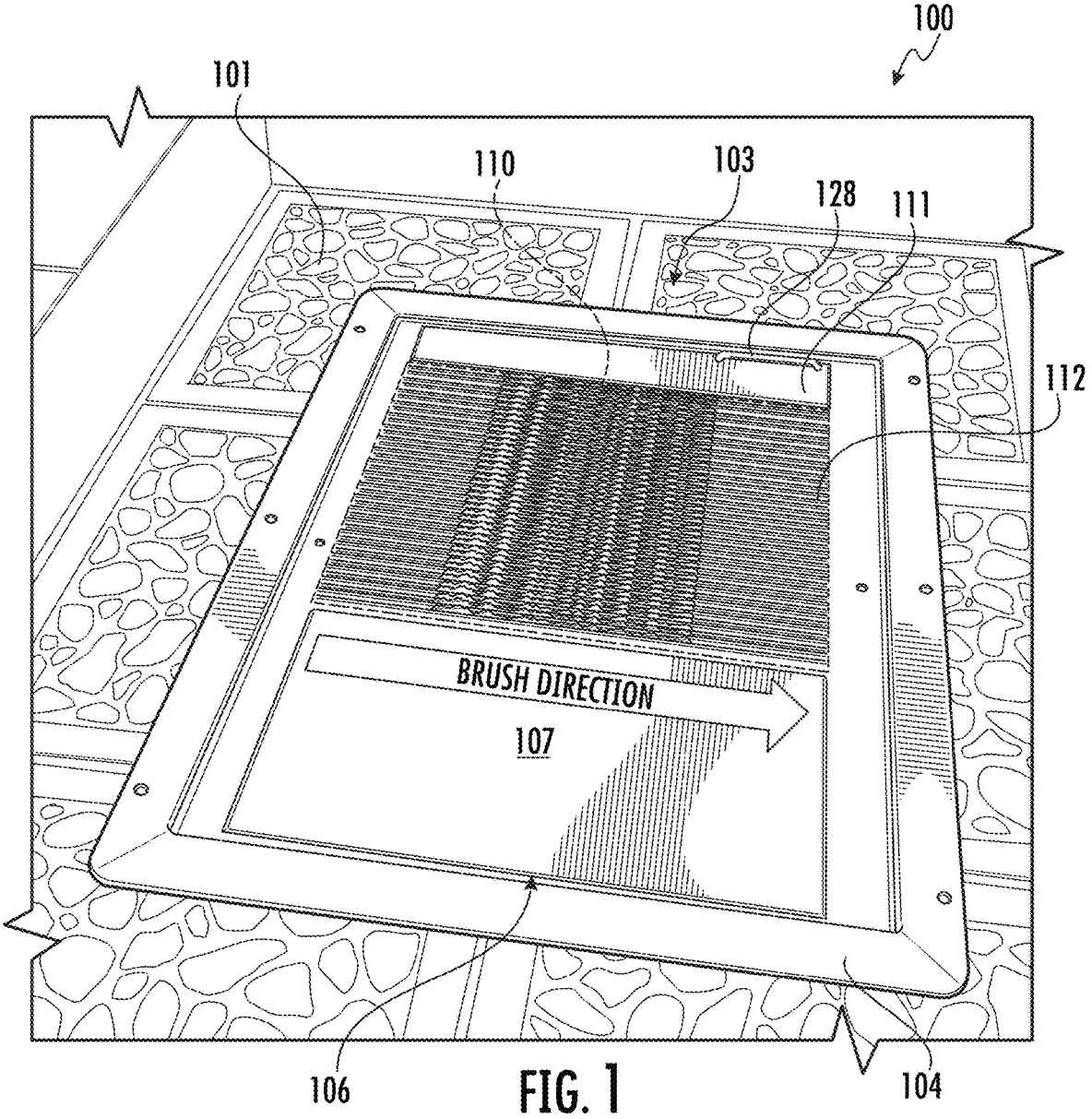
FIG. 1 is a perspective view of a boot scrubber device with the plate in a first position, according to the present disclosure.
Figure 2:
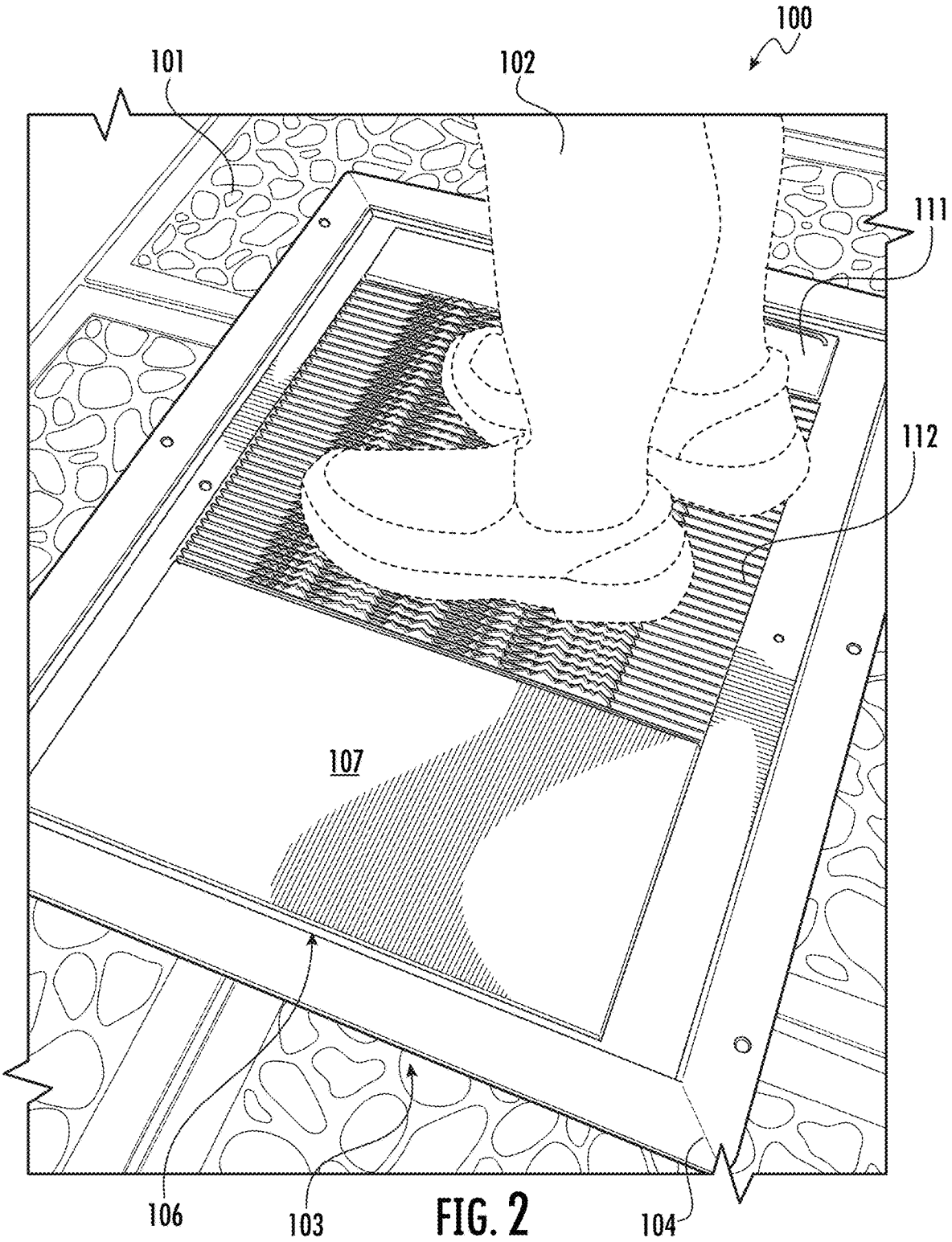
FIG. 2 is another perspective view of the boot scrubber device from FIG. 1 with the user standing thereon.
Figure 3:
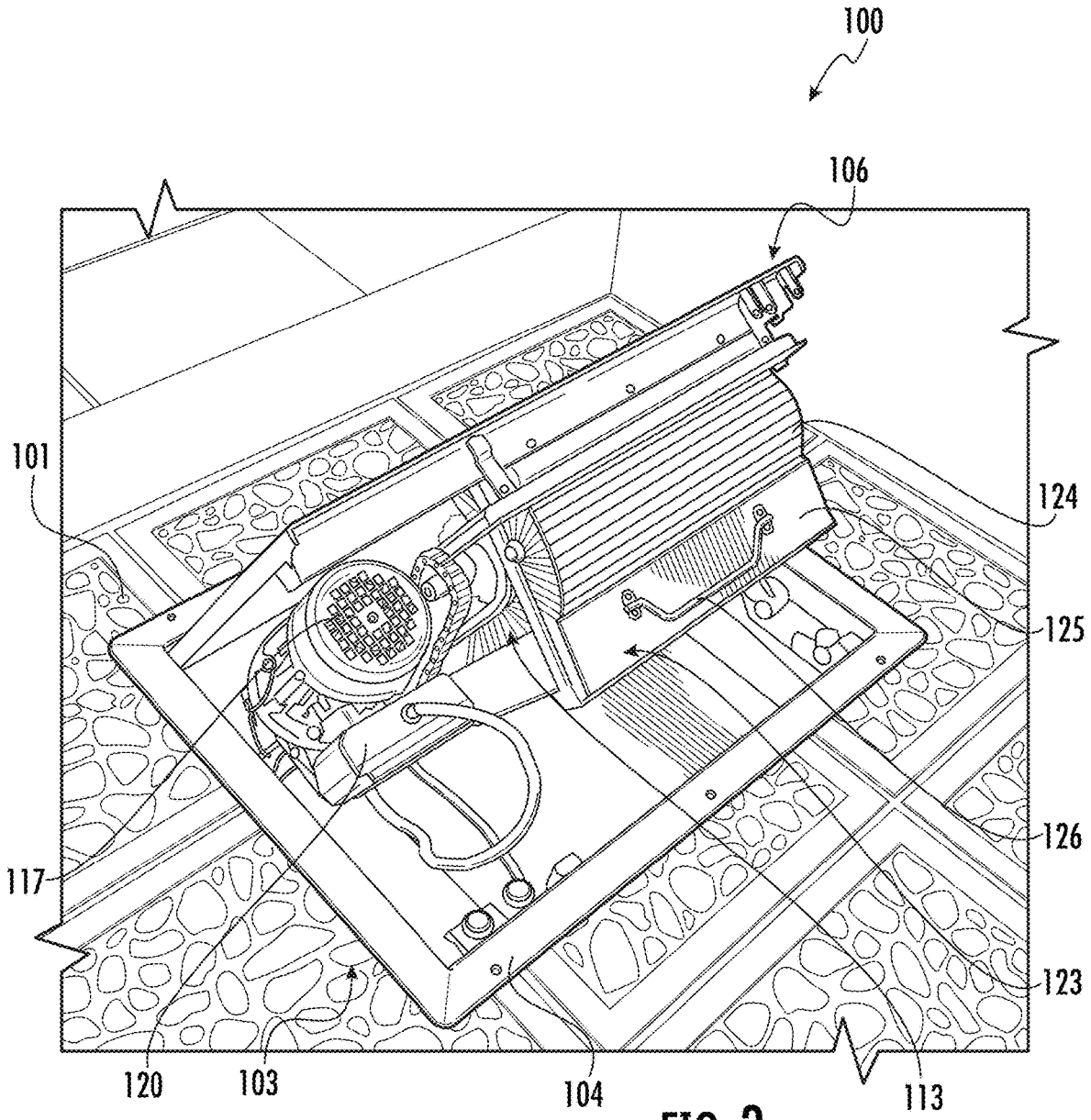
FIG. 3 is another perspective view of the boot scrubber device from FIG. 1 with the plate in a second position.

The present disclosure will now be described more fully hereinafter with reference to the accompanying drawings, in which several embodiments of the invention are shown. This present disclosure may, however, be embodied in many different forms and should not be construed as limited to the embodiments set forth herein. Rather, these embodiments are provided so that this disclosure will be thorough and complete, and will fully convey the scope of the present disclosure to those skilled in the art. Like numbers refer to like elements throughout, and base 100 reference numerals are used to indicate similar elements in alternative embodiments.

Referring to FIGS. 1-6, a boot scrubber device 100 according to the present disclosure is now described. As perhaps best seen in FIG. 1, the boot scrubber device 100 is integral and installed within a floor 101. In particular, the boot scrubber device 100 is flush with adjacent portions of the floor 101, which provides a smooth and safe walking surface for a user 102 (i.e., no tripping hazard).

The boot scrubber device 100 illustratively includes a housing assembly 103 comprising a frame 104 to be received by the floor 101 and defining an opening 105 therein, a plate 106 pivotably coupled to the frame and received within the opening, and a subsurface frame 108 coupled under the plate. The housing assembly 103 may comprise a rigid material with mechanical strength to support the user 102, for example, metallic material. The plate 106 is pivotably coupled to the frame 104 at a rear end. In the illustrated embodiment, both the opening 105 and the plate 106 are rectangle-shaped, but in other embodiments, the shapes may vary but must be identical to ensure solid fit. In FIG. 1, proceeding from the bottom in an upward direction, the plate 106 illustratively includes a first cover section 107 for shielding equipment beneath it, a brush opening 110, a second cover section 111, and a grate 112 extending over the brush opening and for supporting the user 102. As perhaps best seen in FIG. 2, the grate 112 illustratively comprises a plurality of vertical bars. The grate 112 may comprise a rigid material with mechanical strength to support the user 102, for example, metallic material.

Figure 6:
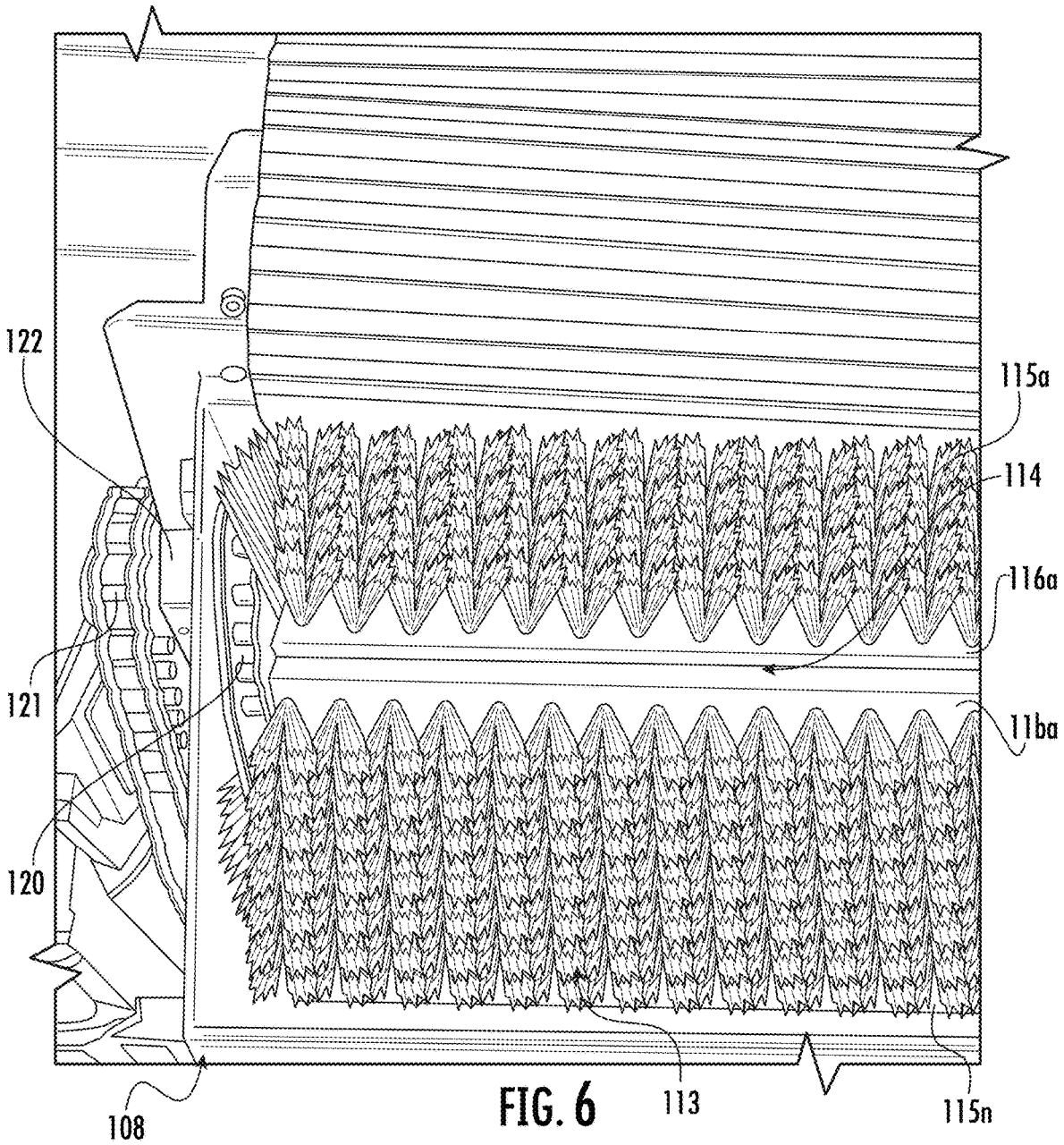
FIG. 6 is an enlarged perspective view of a belt brush assembly of the boot scrubber device from FIG. 1.

As perhaps best seen in FIG. 6, the boot scrubber device 100 illustratively comprises a belt brush assembly 113 carried by the housing assembly 103 and aligned with the brush opening 110. The belt brush assembly 113 illustratively comprises a belt base 114, and a plurality of laterally arranged brushes 115*a*-115*n* (being transverse to the plurality of vertical bars from the grate 112) carried by the belt base. The belt base comprises a plurality of longitudinal strips 116*a*-116*b* coupled together, and a plurality of brush sets respectively coupled to the plurality of longitudinal strips and defining the plurality of laterally arranged brushes 115*a*-115*n*.

The boot scrubber device 100 includes a motor 117 (e.g., an electric motor, 110 Volt, 0.25 Hp) carried by the housing assembly 103 and configured to drive the belt brush assembly 113, and a controller 120 carried by the housing assembly and configured to activate the motor when the user 102 steps on the plate 106.

Figure 7:
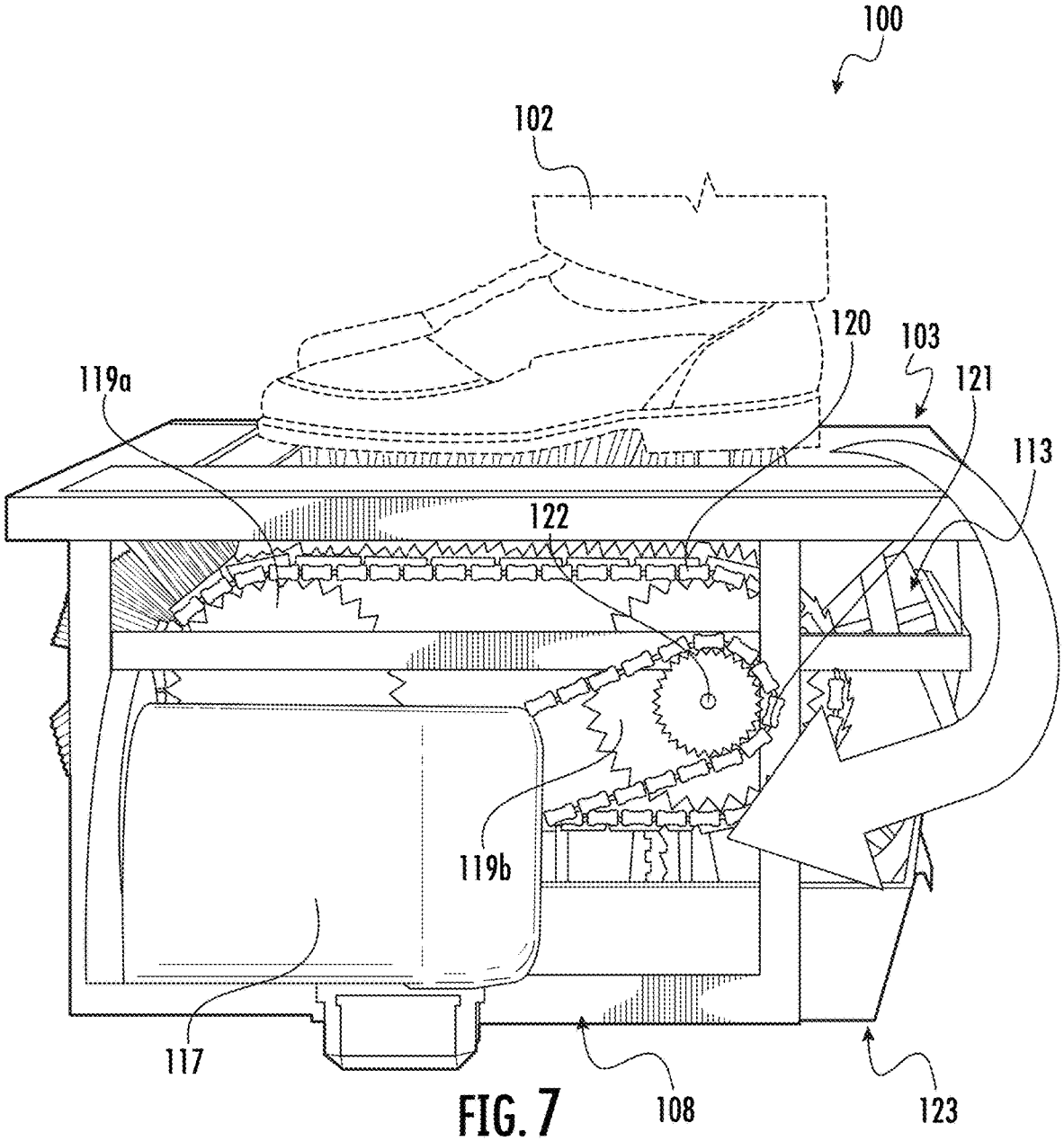
FIG. 7 is a side view of the boot scrubber device from FIG. 1 without adjacent floor portions.

As perhaps best seen in FIG. 7, the belt brush assembly 113 illustratively comprises a first chain 120 coupled to the belt base 114 via first and second drive gears 119*a*-119*b*, and the motor 117 is configured to drive the first chain. The belt brush assembly 113 illustratively includes a second chain 121, and a sprocket gear 122 coupled between the first chain 120 and the second chain. The motor 117 is configured to directly drive the second chain 121, which in turn drives the first chain 120. Of course, in some embodiments, the motor 117 may have its axle directly connected to the belt base 114 via a sprocket gear.

The subsurface frame 108 illustratively carries the belt brush assembly 113 and the motor 117. The boot scrubber device 100 illustratively includes a waste bin 123 carried by the subsurface frame 108 under the belt brush assembly 113. The waste bin 123 is configured to collect debris from shoes of the user 102. The boot scrubber device 100 further comprises a flap 124 carried by the subsurface frame 108 adjacent to the belt brush assembly 113. The flap 124 is configured to urge the debris into the waste bin 123, and may comprise a durable material, such as rubber or polymer plastic. As perhaps best seen in FIG. 1, the plurality of laterally arranged brushes 115*a*-115*n* rotates in a clockwise direction from rear to front. This action removes debris from the footwear of the user 102 and, via the flap 124, and into the waste bin 123.

Figure 4:
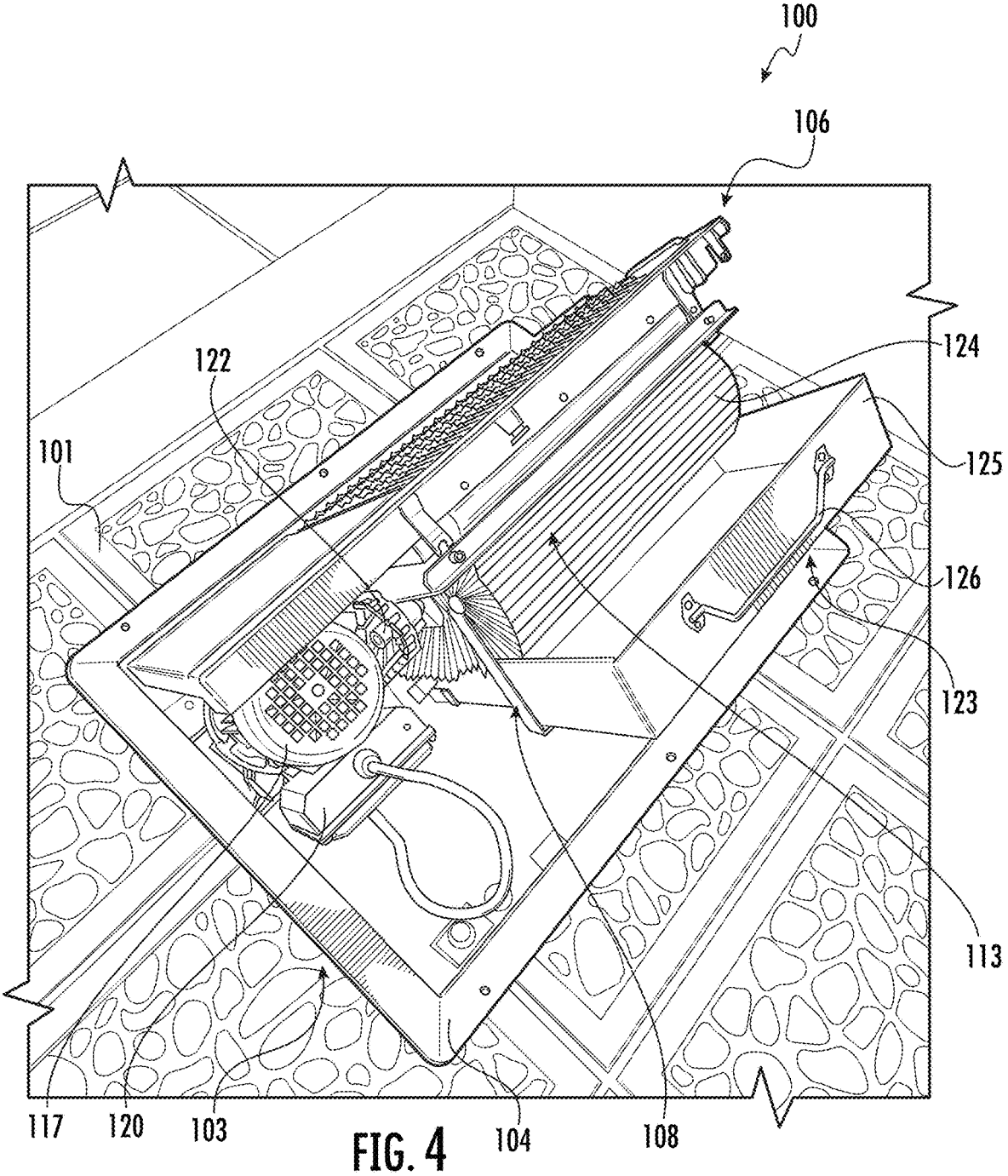
FIG. 4 is another perspective view of the boot scrubber device from FIG. 1 with the plate in the second position and the waste bin partially slidingly removed.
Figure 5:
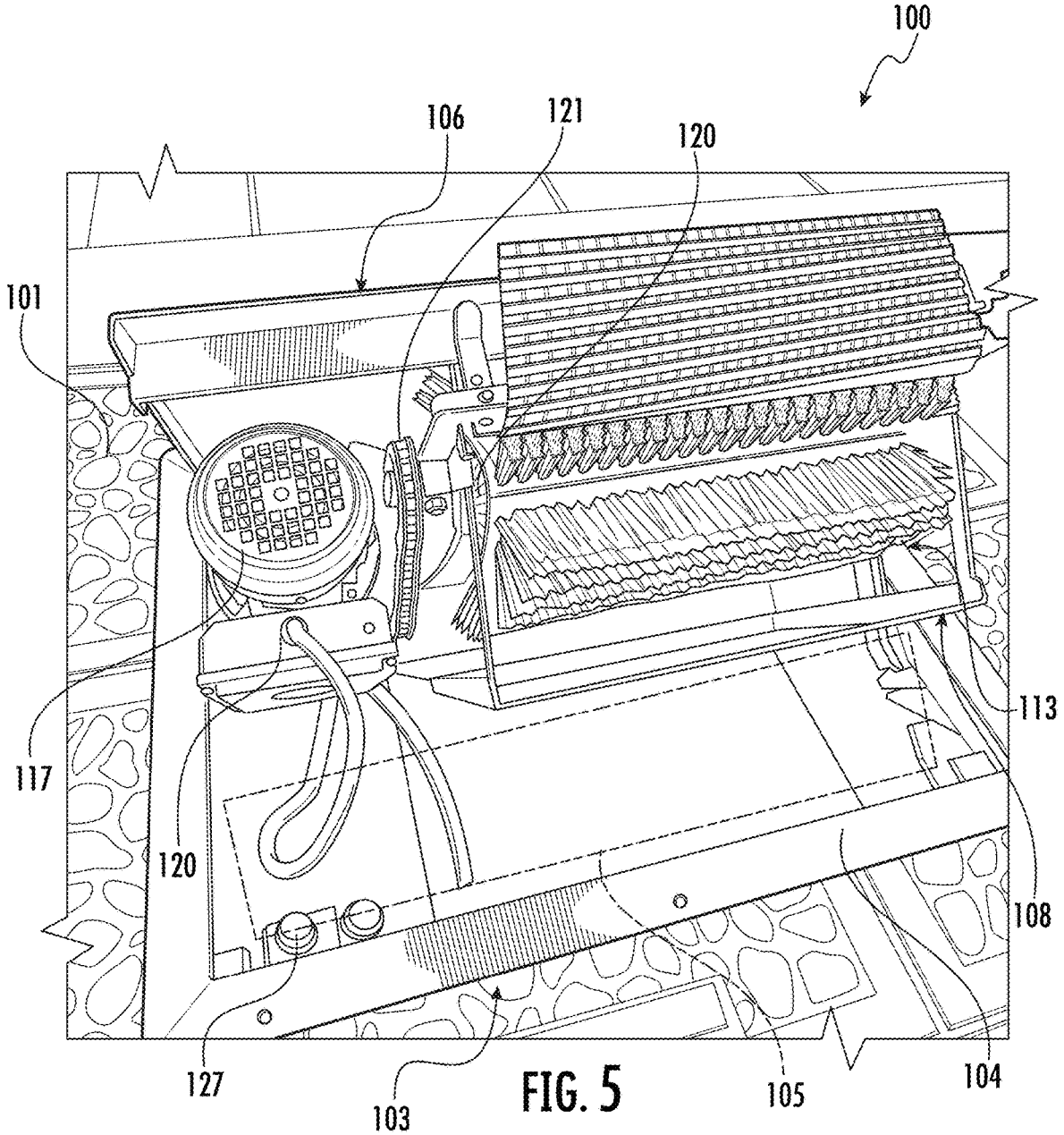
FIG. 5 is another perspective view of the boot scrubber device from FIG. 1 with the plate in the second position and the waste bin removed.

As perhaps best seen in FIGS. 4-5, the waste bin 123 comprises a body 125 defining a recess therein, and a handle 126 coupled to the body. The plate 106 is configured to pivot between a first position (FIGS. 1-2) being flush with the frame 104 and the floor 101, and a second position (FIGS. 3-6) being transverse to the frame and the floor, thereby permitting the waste bin 123 to be slidingly removed from the subsurface frame. Further, the plate 106 comprises a handle 128 for permitting the user 102 to easily pivot the plate into the second position, and a latch to lock the plate in the second position and permit easy removal of the waste bin 123.

The boot scrubber device 100 illustratively includes a pressure sensor 127 carried by the housing assembly 103 and coupled to the controller 120, and the controller is configured to detect when the user 102 steps on the plate 106 based upon the pressure sensor.

Another aspect is directed to a method for making a boot scrubber device 100 within a floor 101. The method includes positioning a housing assembly 103 comprising a frame 104 to be received by the floor 101 and defining an opening 105 therein, and a plate 106 pivotably coupled to the frame and received within the opening, the plate defining a brush opening 110. The method also includes coupling a belt brush assembly 113 to be carried by the housing assembly 103 and aligned with the brush opening 110. The belt brush assembly 113 includes a belt base 114, and a plurality of laterally arranged brushes 115*a*-115*n* carried by the belt base. The method further comprises coupling a motor 117 to be carried by the housing assembly 103 and configured to drive the belt brush assembly 113, and coupling a controller 120 to be carried by the housing assembly and configured to activate the motor when a user 102 steps on the plate.

Advantageously, the boot scrubber device 100 may provide for several benefits over existing approaches. Firstly, the boot scrubber device 100 is integrated into the floor 101, which allows for deployment in more applications, such as residential. This configuration is more aesthetically pleasing than typical boot scrubber devices. Secondly, the boot scrubber device 100 is a low maintenance product, and is easily emptied. Thirdly, the boot scrubber device 100 uses COTS components and is readily manufactured at low cost.

Many modifications and other embodiments of the present disclosure will come to the mind of one skilled in the art having the benefit of the teachings presented in the foregoing descriptions and the associated drawings. Therefore, it is understood that the present disclosure is not to be limited to the specific embodiments disclosed, and that modifications and embodiments are intended to be included within the scope of the appended claims.

The invention claimed is:

1. A boot scrubber device within a floor, the boot scrubber device comprising:

a housing assembly comprising a frame to be received by the floor and defining an opening therein, a plate pivotably coupled to the frame and received within the opening, the plate defining a brush opening, and a subsurface frame coupled to an underside of the plate;

a belt brush assembly carried by the subsurface frame and aligned with the brush opening, the belt brush assembly comprising a belt base, and a plurality of laterally arranged brushes carried by the belt base;

a motor carried by the subsurface frame and configured to drive the belt brush assembly; and a controller carried by the housing assembly and configured to activate the motor when a user steps on the plate.

2. The boot scrubber device of claim 1 further comprising a waste bin carried by the subsurface frame under the belt brush assembly, the waste bin configured to collect debris from shoes of the user.

3. The boot scrubber device of claim 2 further comprising a flap carried by the subsurface frame adjacent to the belt brush assembly, the flap configured to urge the debris into the waste bin.

4. The boot scrubber device of claim 2 wherein the waste bin comprises a body defining a recess therein, and a handle coupled to the body.

5. The boot scrubber device of claim 2 wherein the plate is configured to pivot between a first position being flush with the frame and the floor, and a second position being transverse to the frame and the floor, thereby permitting the waste bin to be slidingly removed from the subsurface frame.

6. The boot scrubber device of claim 1 wherein the belt brush assembly comprises a first chain coupled to the belt base; and wherein the motor is configured to drive the first chain.

7. The boot scrubber device of claim 6 wherein the belt brush assembly comprises a second chain, and a sprocket gear coupled between the first chain and the second chain; and wherein the motor is configured to drive the first chain via the second chain.

8. The boot scrubber device of claim 1 wherein the belt base comprises a plurality of longitudinal strips coupled together, and a plurality of brush sets respectively coupled to the plurality of longitudinal strips.

9. The boot scrubber device of claim 1 further comprising a pressure sensor carried by the housing assembly and coupled to the controller; and wherein the controller is configured to detect when the user steps on the plate based upon the pressure sensor.

10. A boot scrubber device within a floor, the boot scrubber device comprising:

a housing assembly comprising
- a frame to be received by the floor and defining an opening therein,
- a plate pivotably coupled to the frame and received within the opening, the plate defining a brush opening, and
- a subsurface frame coupled to an underside of the plate;

a belt brush assembly carried by the subsurface frame and aligned with the brush opening, the belt brush assembly comprising a belt base, and a plurality of laterally arranged brushes carried by the belt base, the belt base comprising
- a plurality of longitudinal strips coupled together, and
- a plurality of brush sets respectively coupled to the plurality of longitudinal strips;

a motor carried by the subsurface frame and configured to drive the belt brush assembly;

a pressure sensor carried by the housing assembly; and a controller carried by the housing assembly and configured to detect when a user steps on the plate based upon the pressure sensor, and activate the motor when the user steps on the plate.

11. The boot scrubber device of claim 10 further comprising a waste bin carried by the subsurface frame under the belt brush assembly, the waste bin configured to collect debris from shoes of the user.

12. The boot scrubber device of claim 11 further comprising a flap carried by the subsurface frame adjacent to the belt brush assembly, the flap configured to urge the debris into the waste bin.

13. The boot scrubber device of claim 11 wherein the waste bin comprises a body defining a recess therein, and a handle coupled to the body.

14. The boot scrubber device of claim 11 wherein the plate is configured to pivot between a first position being flush with the frame and the floor, and a second position being transverse to the frame and the floor, thereby permitting the waste bin to be slidingly removed from the subsurface frame.

15. The boot scrubber device of claim 10 wherein the belt brush assembly comprises a first chain coupled to the belt base; and wherein the motor is configured to drive the first chain.

16. The boot scrubber device of claim 15 wherein the belt brush assembly comprises a second chain, and a sprocket gear coupled between the first chain and the second chain; and wherein the motor is configured to drive the first chain via the second chain.

17. A method for making a boot scrubber device within a floor, the method comprising:

positioning a housing assembly comprising
- a frame to be received by the floor and defining an opening therein,
- a plate pivotably coupled to the frame and received within the opening, the plate defining a brush opening, and
- a subsurface frame coupled to an underside of the plate;

coupling a belt brush assembly to be carried by the subsurface frame and aligned with the brush opening, the belt brush assembly comprising a belt base, and a plurality of laterally arranged brushes carried by the belt base;

coupling a motor to be carried by the subsurface frame and configured to drive the belt brush assembly; and coupling a controller to be carried by the housing assembly and configured to activate the motor when a user steps on the plate.

18. The method of claim 17 further comprising coupling a waste bin to be carried by the subsurface frame under the belt brush assembly, the waste bin configured to collect debris from shoes of the user.

19. The method of claim 18 further comprising coupling a flap to be carried by the subsurface frame adjacent to the belt brush assembly, the flap configured to urge the debris into the waste bin.

20. The method of claim 18 wherein the waste bin comprises a body defining a recess therein, and a handle coupled to the body.

* * * * *